US010857593B2

(12) United States Patent
Renggli et al.

(10) Patent No.: US 10,857,593 B2
(45) Date of Patent: Dec. 8, 2020

(54) METHOD AND DEVICE FOR REPAIRING A REFRACTORY SHELL OF A METALLURGICAL VESSEL

(71) Applicant: Refractory Intellectual Property GmbH & Co. KG, Wein (AT)

(72) Inventors: Raphael Renggli, Ebikon (CH); Damian Schacher, Inwil (CH); Paul Guenther, Trieben (AT)

(73) Assignee: Refractory Intellectual Property GmbH & Co. KG, Wein (AT)

( * ) Notice: Subject to any disclaimer, the term of this patent is extended or adjusted under 35 U.S.C. 154(b) by 249 days.

(21) Appl. No.: 15/551,972

(22) PCT Filed: Dec. 4, 2015

(86) PCT No.: PCT/EP2015/078719
§ 371 (c)(1),
(2) Date: Aug. 18, 2017

(87) PCT Pub. No.: WO2016/131510
PCT Pub. Date: Aug. 25, 2016

(65) Prior Publication Data

US 2018/0029117 A1 Feb. 1, 2018

(30) Foreign Application Priority Data

Feb. 20, 2015 (CH) ..... 0243/15

(51) Int. Cl.
*B22D 41/52* (2006.01)
*C21C 5/44* (2006.01)
(Continued)

(52) U.S. Cl.
CPC ..... *B22D 41/52* (2013.01); *C21C 5/445* (2013.01); *F27D 1/1626* (2013.01); *F27D 3/1536* (2013.01); *C21B 7/12* (2013.01)

(58) Field of Classification Search
CPC ..... F27D 1/16; C04B 2111/72; B22D 41/52
(Continued)

(56) References Cited

U.S. PATENT DOCUMENTS 3,034,729 A * 5/1962 Gray ..... B05C 7/02 239/214.25
3,737,489 A * 6/1973 Murton ..... B22C 15/20 264/30
(Continued)

FOREIGN PATENT DOCUMENTS

BE 1002746 A6 5/1991
EP 2435201 A1 * 4/2012 ..... B22D 41/22
(Continued)

OTHER PUBLICATIONS

Abstract of BE 1002746 A6.
Abstract of JPH-01119514 A.

*Primary Examiner* — Timothy Kennedy
*Assistant Examiner* — Farah Taufiq
(74) *Attorney, Agent, or Firm* — Brian Roffe

(57) ABSTRACT

Method and device for repairing the spout sleeve of a metallurgical vessel fitted securely within the refractory lining of the vessel in which the sleeve is repaired by applying mortar to the casting channel of the sleeve with a mortar dispenser inserted into the casting channel, which upon removing the mortar dispenser from the casting channel calibrates the latter over the entire length of the channel. The mortar dispenser is driven rotating coaxially to the casting channel during the mortar application and, after a defined time, is removed from the casting channel, still rotating. The method is particularly suitable for repairing the inner sleeve of a casting ladle with a slide closure adjoining the ladle spout, maintenance of which is automatically carried out in a maintenance station of the casting facility.
(Continued)

Repair of the inner sleeve is also carried out automatically here during the maintenance of the slide closure.

20 Claims, 2 Drawing Sheets

(51) Int. Cl.
*F27D 3/15* (2006.01)
*F27D 1/16* (2006.01)
*C21B 7/12* (2006.01)

(58) Field of Classification Search
USPC ..... 264/30
See application file for complete search history.

(56) References Cited

U.S. PATENT DOCUMENTS 4,023,781 A 5/1977 Fritz et al.
4,199,084 A 4/1980 Hansen et al.
4,217,079 A 8/1980 Smith et al.
4,440,350 A 4/1984 Dietz et al.
4,532,885 A 8/1985 Nunlist
5,259,880 A * 11/1993 Fujita ..... C21B 7/12 118/311
5,415,692 A 5/1995 Fujita et al.
5,452,853 A 9/1995 Shook et al.
5,527,169 A 6/1996 Goldenberg et al.
6,142,187 A 11/2000 Goldenberg et al.
6,902,758 B2 6/2005 Donatti et al.
7,132,127 B2 11/2006 Belik
7,963,371 B2 6/2011 Belik
2005/0126478 A1 6/2005 Donatti et al.
2010/0263764 A1 10/2010 Cox
2013/0286184 A1 10/2013 Gunther

FOREIGN PATENT DOCUMENTS

GB 1042167 A 9/1966
GB 20146887 B 11/1980
JP H-01119614 A 5/1989
WO 2016131510 A1 8/2016

* cited by examiner

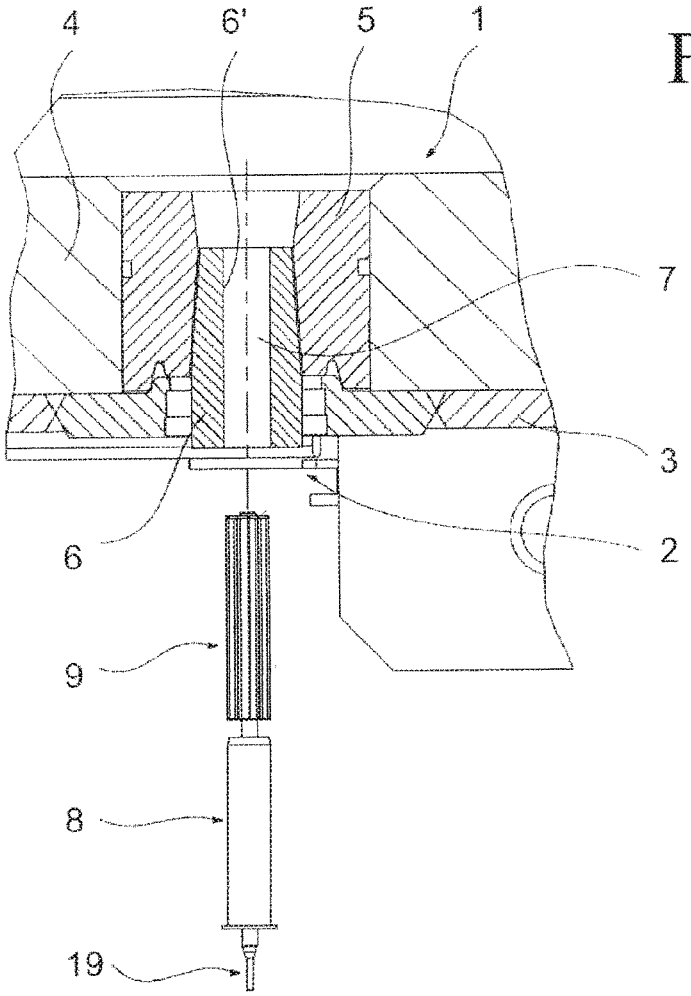
Fig. 1
Fig. 2
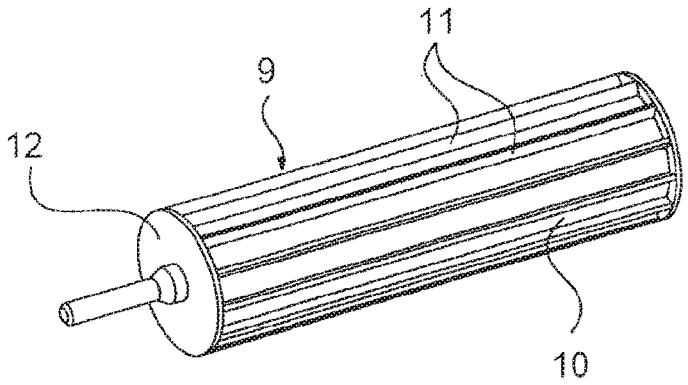
Fig. 3
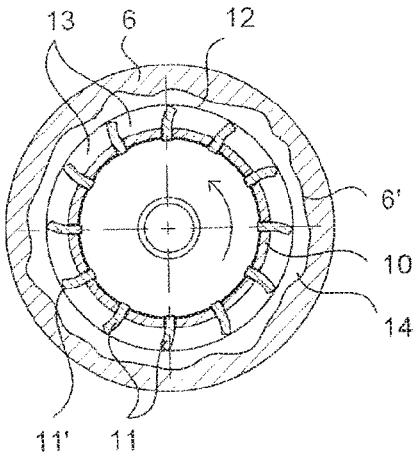

METHOD AND DEVICE FOR REPAIRING A REFRACTORY SHELL OF A METALLURGICAL VESSEL

FIELD OF THE INVENTION

The invention relates to a method for repairing a refractory sleeve of a metallurgical vessel which is fitted in a refractory lining of the vessel or in a mechanism and to an apparatus for implementing the method.

The invention relates to a method for repairing a refractory sleeve of a metallurgical vessel according to the preamble to claim 1 and to an apparatus for implementing the method.

BACKGROUND OF THE INVENTION

Refractory sleeves of the type specified at the start are, among other things, the inner sleeves of casting ladles containing molten metal. The inner sleeve is inserted into a perforated brick of the refractory ladle lining and adjoins the closure plate of a slide closure on the outside.

The inner sleeve forms the pouring channel of the casting ladle and so is subjected to a great deal of wear during operation. It is therefore often necessary to replace the worn sleeves with new, undamaged sleeves. However, this process is normally very laborious because one must first of all break out the worn sleeve, repair the damaged bearing surface of the perforated brick and then fit the new sleeve such that it is correctly centred within the vessel. This results in long down times for the vessels in question.

A method for repairing the tap holes of metallurgical vessels is known from patent AT-A-242 175 that is implemented with a section of pipe that can be introduced into the tap hole as a mortar dispenser. However, the known method is unsuitable for repairing spout sleeves because the section of pipe serving as the mortar dispenser has bore holes distributed around the circumference and has exactly the same outside diameter as the target diameter of the spout to be repaired. The result of this, on the one hand, is that the mortar is not applied evenly to the damaged channel wall, and on the other hand, is that after having applied the mortar to the spout there is the risk that the applied mortar layer will be damaged when the perforated section of pipe is removed.

OBJECTS AND SUMMARY OF THE INVENTION

The object underlying the invention is to devise a method for repairing worn sleeves such that, by means of this method, the operational reliability and dimensional accuracy of the repaired sleeves is guaranteed.

According to the invention, this object is achieved by the sleeve repair being carried out by applying mortar to the casting channel of the sleeve with a mortar dispenser that can be inserted into the casting channel in a way known in its own right, and which, when withdrawn from the casting channel, calibrates it over the entire length of the channel, the mortar dispenser being rotated coaxially to the casting channel during the application of the mortar and being withdrawn from the casting channel, still rotating, after a defined period of time.

The repair method according to the invention can be implemented with relatively uncomplex apparatus because the rotating mortar dispenser provides even application of mortar to the channel wall and precise calibration of the casting channel.

Another advantage of the method is minimized expenditure of time because it can be implemented with a relatively high vessel temperature and because both the application of the mortar and the curing of the applied mortar mass take place quickly.

In addition, the method makes it possible to automate the function of the mortar dispenser and to adapt to essential parameters such as the composition of the sleeve or of the respectively used mortar.

These advantages are of particular significance if the method according to the invention is used to repair the inner sleeve of a casting ladle with a slide closure adjoining the ladle spout, maintenance of which is carried out automatically by a robot in a maintenance station of the casting facility. In this case the invention makes provision such that the repair to the inner sleeve is also carried out automatically here during the maintenance of the slide closure, preferably with the same robot.

In this way, it is possible to repair the inner sleeve during the changeover process for every plate change instead of replacing it with a new sleeve after a small number of castings. In this way, the cost of the refractory material is reduced and the time required for the maintenance of the ladle is minimized.

Within this context it is advantageous if when applying mortar to the casting channel of the sleeve the mortar dispenser is rotated with a relatively fast rotation speed which is such that the mortar mass is sprayed onto the channel wall of the sleeve with a strong centrifugal effect by virtue of the centrifugal force that is generated.

It is also advantageous for better adhesion of the mortar if the mortar dispenser is also rotated for a specific amount of time dependent upon the composition of the mortar after the start of the mortar curing process.

Furthermore, the invention makes provision such that upon removing the rotating mortar dispenser from the casting channel, the mortar mass sprayed onto the channel wall is wiped away helically by the mortar dispenser, the rotation speed of the mortar dispenser being able to be set dependently upon the composition of the mortar and the structure and composition of the channel wall. In this way the removal of the mortar dispenser from the casting channel is facilitated, and at the same time the latter obtains an immaculately smooth inner wall.

In order to optimize the application and smoothing of the mortar mass, the invention also makes provision such that the mortar is applied to the sleeve at a sleeve temperature of preferably over 300° C.

The apparatus according to the invention for implementing the proposed method is characterized in that the mortar dispenser is formed by a section of pipe rotating about the longitudinal axis and that has radially longitudinally directed blades, the length of which corresponds to the casting channel length of the sleeve to be repaired and the outside diameter of which, defined by the blades, is equal to the target value of the casting channel diameter of the sleeve.

During the application of mortar the mortar mass is evenly centrifuged onto the channel wall of the sleeve by the rotating blades so that the channel wall is covered with a compact and well-adhering mortar layer. Within this context it is advantageous if the blades are slightly convexly curved in the direction of rotation of the section of pipe.

The blades that rotate helically when the apparatus is removed bring about precise calibration of the casting channel with an immaculately smooth channel surface.

BRIEF DESCRIPTION OF THE DRAWINGS

The invention will be described in more detail below by means of an exemplary embodiment with reference to the drawings. These show as follows:

FIG. 1 is a ladle spout with an apparatus for repairing the inner sleeve by the method according to the invention, illustrated diagrammatically as a section;

FIG. 2 is the apparatus according to FIG. 1 in a perspective view;

FIG. 3 is a section of the apparatus according to FIG. 2 and of the inner sleeve;

DETAILED DESCRIPTION OF THE INVENTION

Figure 4:
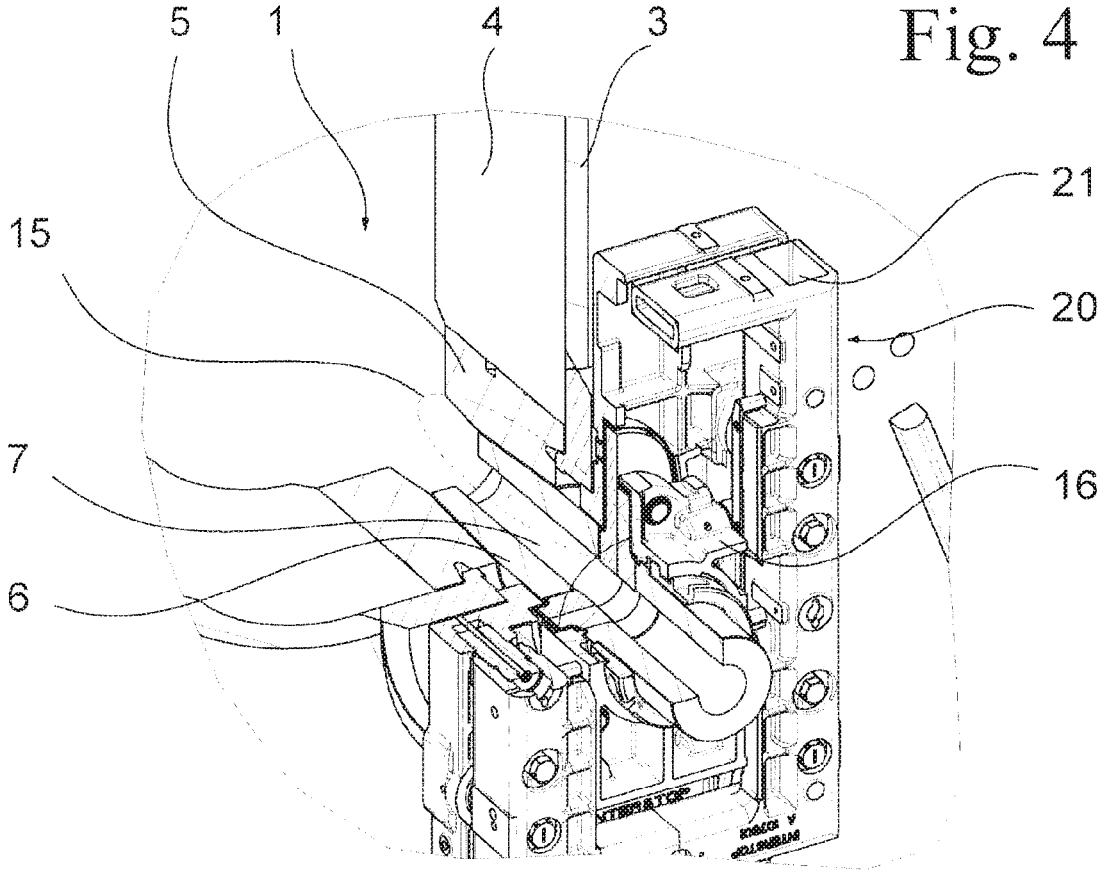
FIG. 4 is an angled section of a ladle spout with a slide closure adjoining the inner sleeve at the ladle position of a casting facility.

FIG. 1 shows a partial region of a steel ladle 1, the spout 2 of which can be provided with a slide closure (not shown). The steel ladle 1 has an outer steel jacket 3 with a refractory lining 4 in which a refractory perforated brick 5 is fitted in order to accommodate an inner sleeve 6 made of refractory material.

During operation, the sleeve 6 is subjected to a great deal of wear on its inner wall 6' in the region of the casting channel 7. For this reason, the sleeve 6 is no longer serviceable after a certain number of castings.

According to the invention, the sleeve repair takes place by applying mortar to the inner wall 6' of the sleeve 6 with a mortar dispenser 9 that can be inserted into the casting channel 7. Through the mortar dispenser 9, the mortar is conveyed to the outside into a cavity 14 formed between the mortar dispenser 9 and the worn inner wall 6' of the sleeve 6.

After subsequently removing the mortar dispenser from the casting channel 7, the sleeve is mortared with sufficient adhesion and calibrated over the entire length of the channel.

According to the invention, the apparatus 8 is actuated such that the mortar dispenser 9 rotates relatively quickly coaxially to the casting channel 7 for a defined time during the mortar application, and is removed from the casting channel, still rotating, during the curing of the mortar. The inner wall 6' of the restored casting channel 7 is thus processed to be evenly smooth, and during casting molten metal that is flowing through is prevented from being retained and possibly adhering due to irregularities.

The rotational speed of the mortar dispenser 9 corresponds, for example, to that of a hand drill with approx. 500 to 1,000 rotations per minute. A drive shaft 19 coupled to the mortar dispenser for rotary drive is shown.

During trials relating to this, it was established that it is advantageous if the mortar dispenser 9 is rotated for a total of, for example, 60 seconds, and if the mortar is applied to the inner wall of the sleeve at a sleeve temperature of preferably over 300° C. In this way, the sleeve repair can be carried out while the casting ladle is still hot.

In order to repair the inner sleeve by the method according to the invention, the types of mortar commonly used for similar purposes are considered. The rotational speed of the apparatus can be set dependently upon the composition of the mortar and the structure and composition of the channel wall.

As can be seen from FIG. 2 and FIG. 3, the mortar dispenser 9 consists of a cylindrical section of pipe 10 with radially longitudinally directed blades 11, the length of the section of pipe corresponding to the casting channel length of the sleeve 6, whereas its outside diameter defined by the blades 11 is equal to the target value of the channel diameter of the inner sleeve. In the exemplary embodiment described the blades 11 are aligned axially parallel to the section of pipe 10 and are delimited on both ends by disc-shaped flanges 12 so that elongate spaces 13 are formed between the individual blades in order to accommodate the refractory mortar.

By rotating the section of pipe 10 the mortar is centrifuged out of the spaces 13 and applied evenly to the worn inner wall 6' of the sleeve 6 over the entire channel length, the centrifuging effect contributing to the mortar being able to adhere securely to the inner wall 6' and the cavity 14 that is formed in between. In order to increase this centrifuging effect, it is advantageous if the blades 11 are slightly convexly curved in the direction of rotation of the section of pipe 10 so that the mortar can be pushed out over the outer edges 11' that are formed, and these edges 11' having a cutting effect.

The blades 11 that rotate with the section of pipe 10 also serve to wipe away the excess mortar and to calibrate the casting channel of the inner sleeve without the channel wall being damaged thereby. This also applies when removing the apparatus because then the section of pipe 10 that continues to rotate executes a helical movement that significantly supports the removal process.

Advantageously, these spaces 13 of the mortar dispenser 9 are dimensioned such that a pre-determined amount of mortar can be poured into the latter, for example by hand, the amount of mortar corresponding approximately to the cavity 14 formed between the mortar dispenser and the inner wall of the sleeve so that this wiping away of the excess mortar is made possible. These spaces 13 are therefore filled with mortar such that this mortar is poured in so that it is approximately flush with the outer circumference of the blades 11 and is evenly distributed here.

The sleeve repair method according to the invention is particularly suitable for casting facilities in which the maintenance and preparation of the slide closure of the ladles is carried out centrally by means of a robot in a maintenance station—the so-called ladle position.

FIG. 4 shows the spout of a casting ladle 1 located in the maintenance station into the perforated brick 5 of which an inner sleeve 6 is inserted. Adjoining the latter is a slide closure 20, known in its own right, for closing and opening the casting channel 7. During operation the wear zone 15 extends from the free passage region of the perforated brick 5 to the exit of the inner sleeve 6, a refractory closure plate (not shown) into the housing 21 of the slide closure 20 tightly adjoining the inner sleeve.

In FIG. 4, the casting ladle 1 is in the maintenance position in which it is laid horizontally. The slide closure 20 is partially shown in section with the refractory components that can be inserted into its mechanism, namely the closure plate, the slider plate and the spout sleeve. After swiveling out the slider unit 16 of the slide closure and removing the base plate, the sleeve 6 of the casting ladle is freely accessible and can be repaired in the maintenance station while the maintenance and preparation of the slide closure is carried out. The repair takes place automatically here, preferably with the robot used for changing plates.

Figure 5:
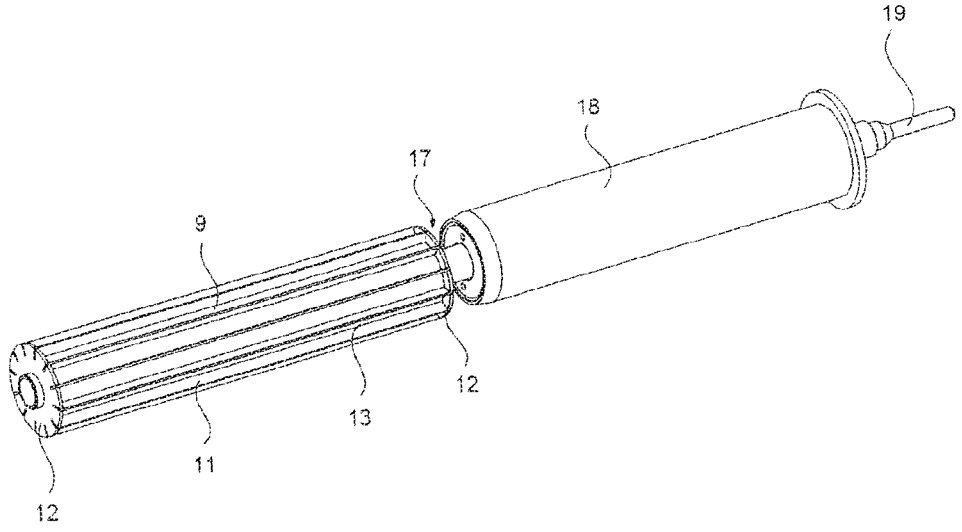
FIG. 5 is a perspective view of a variant of the apparatus.

FIG. 5 shows a repair apparatus 17 suitable for this purpose. It only differs from the apparatus 8 according to FIG. 2 in that, in order to couple the apparatus to the robot, it has a second section of pipe 18 of a mortar feed device provided as an extension of the section of pipe 10 and which can at the same time serve to supply the other section of pipe 10 with mortar. The repair apparatus 17 is automatically positioned precisely with the robot and is driven by its drive shaft 19 such that it is rotated in the casting channel 7 with the respectively optimal speed of rotation.

The apparatus according to the invention can readily be designed differently than in the exemplary embodiment described. It is only essential that it functions as described above.

The sleeve repair method according to the invention is of course also suitable for other sleeves that are fastened in a refractory vessel lining and are subjected here to a large amount of wear, such as for those, for example, in a tap of a converter, an electric furnace or in a tundish. Perforated bricks, sleeve inserts, recovery nozzles or sleeve-shaped sprayed channels as sleeves could also be repaired by the method according to the invention.

However, the method is particularly advantageously suitable for repairing the inner sleeves of casting ladles because it offers the possibility of repairing the inner sleeve quickly with each plate change in the course of the automation of the casting operation and so of reducing the requirement for new inner sleeves. The cleaning of the perforated brick otherwise required when changing a sleeve is no longer necessary. The wear of the perforated brick is reduced, and no troublesome fusions occur.

The invention is sufficiently displayed by the exemplary embodiments described above. However, it could also be illustrated by other variants. A refractory replacement spout fastened in the mechanism of a slide closure or the like could thus also be repaired by the method according to the invention.

Instead of blades, other forms of means delimiting the spaces, for example thread-like elevations, could also be provided in the pipe section of the mortar dispenser.

In principle, this mortar could also be conveyed onto the inner wall of a sleeve by pushing to the outside, for example by means of a cylindrical, inflatable balloon-like body or the like.

The invention claimed is:

1. A method for repairing a refractory sleeve in a metallurgical vessel, which is fitted in a refractory lining of the vessel or in a mechanism, comprising:

inserting mortar into and then retaining the mortar in a plurality of axially extending mortar spaces of a mortar dispenser that are separated from one another and each having an opening only on a radial outward side and being bound by structure on a radial inward side, on opposed axial ends and on opposed circumferential sides, the mortar being inserted through the open radial outward side;

inserting the mortar dispenser into a casting channel of the sleeve after the mortar has been inserted into the mortar spaces and while the mortar is retained in the mortar spaces; and then rotating the mortar dispenser to cause the mortar that has been inserted into all of the mortar spaces and is retained in all of the mortar spaces of the mortar dispenser to be centrifuged at the same time out of the mortar spaces and applied to a length of an inner wall of the sleeve corresponding to a length between the structure on the opposed axial ends of the mortar dispenser, the mortar being conveyed outward from the mortar dispenser into a cavity formed between the mortar dispenser and the inner wall of the sleeve.

2. The method according to claim 1, further comprising rotating the mortar dispenser, when applying the mortar to the inner wall of the sleeve, with a rotation speed such that a sufficient amount of the mortar is conveyed or sprayed onto the inner wall of the sleeve to fill the cavity.

3. The method according to claim 1, further comprising, after the mortar dispenser is inserted into the casting channel of the sleeve, rotating the mortar dispenser in the casting channel for a certain time after spraying during the application of the mortar.

4. The method according to claim 3, wherein the mortar dispenser is rotated in the casting channel of the sleeve for a specific amount of time dependent upon composition of the mortar.

5. The method according to claim 1, wherein upon removing the rotating mortar dispenser from the casting channel, an amount of the mortar sprayed onto the inner wall of the channel is wiped away helically by the mortar dispenser.

6. The method according to claim 1, further comprising setting the rotational speed of the mortar dispenser dependently upon composition of the mortar and structure and composition of the inner wall.

7. The method according to claim 1, wherein the mortar is applied to the sleeve at a sleeve temperature of over 300° C.

8. The method according to claim 1, further comprising, in order to repair the sleeve of a casting ladle with a slide closure adjoining a spout of the ladle, maintaining the sleeve automatically by a robot in a maintenance station of a casting facility, the mortar being applied to the sleeve during maintenance of the slide closure in the maintenance station, the mortar dispenser being automatically positioned and driven in order to manipulate the slide closure.

9. An apparatus for implementing the method according to claim 1, wherein the mortar dispenser is formed by a cylindrical section of pipe rotating about a longitudinal axis with the mortar spaces lying on an outside of the section of pipe and being distributed around a circumference of the section of pipe, an amount of mortar being inserted into the mortar spaces corresponding approximately to the cavity formed between the mortar dispenser and the inner wall of the sleeve.

10. The apparatus according to claim 9, wherein the section of pipe of the mortar dispenser is formed with longitudinally directed blades, the structure on the opposed circumferential sides of the mortar spaces comprising the blades, the length of the blades corresponds to the casting channel length of the sleeve to be repaired, wherein an outside diameter of the section of pipe, defined by the blades, is equal to a target value of a casting channel diameter of the sleeve after the repair.

11. The apparatus according to claim 10, wherein the blades are slightly convexly curved in the direction of rotation of the section of pipe.

12. The apparatus according to claim 10, wherein the mortar spaces between the blades are fillable with mortar mass individually or together by a mortar feed device disposed in an extension of the section of pipe.

13. The apparatus according to claim 11, wherein the mortar spaces between the blades are fillable with mortar mass individually or together by a mortar feed device disposed in an extension of the section of pipe.

14. The method according to claim 2, further comprising, upon removing the rotating mortar dispenser from the casting channel, wiping away the mortar mass sprayed onto the inner wall helically by the mortar dispenser.

15. The method according to claim 1, wherein the mortar dispenser is formed by a section of pipe with the mortar spaces lying on an outside of the section of pipe, the section of pipe includes blades extending axially between first and second end flanges to define an elongate space between each adjacent pair of the blades and the first and second end flanges, the elongate spaces constituting the mortar spaces, the structure on the opposed circumferential sides of the mortar spaces comprising the blades and the structure on the opposed axial ends of the mortar spaces comprising the first and second end flanges, the step of inserting mortar into the mortar spaces of the section of pipe of the mortar dispenser comprising filling the mortar spaces through the open radial outward side of each of the mortar spaces until the mortar in the mortar spaces is flush with an outer circumference of the blades.

16. The method according to claim 1, wherein the mortar dispenser is formed by a section of pipe with the mortar spaces lying on an outside of the section of pipe, the section of pipe includes blades extending axially between first and second end flanges to define an elongate space between each adjacent pair of the blades and the first and second end flanges, the elongate spaces constituting the mortar spaces, the structure on the opposed circumferential sides of the mortar spaces comprising the blades and the structure on the opposed axial ends of the mortar spaces comprising the first and second end flanges.

17. The method according to claim 1, wherein the structure on the opposed axial ends of the mortar spaces comprises first and second end flanges of the mortar dispenser spaced apart from one another in an axial direction of the mortar dispenser, the structure on the opposed circumferential sides of the mortar spaces comprises longitudinally extending blades, and the structure on the radial inward side of the mortar spaces comprises a solid portion of a pipe of the mortar dispenser, the mortar, after being inserted into the mortar spaces through the open radial outward side, being retained in the mortar spaces by the first and second end flanges, the blades, and the solid portion of the pipe.

18. The method according to claim 1, wherein the step of inserting mortar into the mortar spaces of the section of pipe of the mortar dispenser comprises manually pouring the mortar into the mortar spaces of the section of pipe through the open radial outward side of each of the mortar spaces.

19. The method according to claim 17, wherein the blades have a length between the first and second end flanges that corresponds to the length of the inner wall of the sleeve, the mortar dispenser being rotated to cause the mortar in all of the mortar spaces of the section of pipe of the mortar dispenser to be centrifuged at the same time out of the mortar spaces through the open radial outward side of each of the mortar spaces and applied to the entire axial length of the inner wall of the sleeve.

20. The method according to claim 16, wherein the blades are parallel to one another.

* * * * *